US009488941B2

(12) United States Patent
Hiramatsu

(10) Patent No.: US 9,488,941 B2
(45) Date of Patent: Nov. 8, 2016

(54) FIXING DEVICE CAPABLE OF RETAINING LUBRICANT BETWEEN NIP MEMBER AND FUSING BELT

(71) Applicant: Brother Kogyo Kabushiki Kaisha, Nagoya-shi, Aichi-ken (JP)

(72) Inventor: Seiji Hiramatsu, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/503,449

(22) Filed: Oct. 1, 2014

(65) Prior Publication Data

US 2015/0093168 A1 Apr. 2, 2015

(30) Foreign Application Priority Data

Oct. 1, 2013 (JP) ..... 2013-206763

(51) Int. Cl.
*G03G 15/20* (2006.01)

(52) U.S. Cl.
CPC ..... *G03G 15/2053* (2013.01); *G03G 15/2025* (2013.01); *G03G 15/2064* (2013.01); *G03G 2215/2035* (2013.01)

(58) Field of Classification Search
CPC ..... G03G 15/2025; G03G 15/2053
USPC ..... 399/328, 329
See application file for complete search history.

(56) References Cited

U.S. PATENT DOCUMENTS

| | | | | |
|---|---|---|---|---|
| 5,091,752 | A * | 2/1992 | Okada | 399/329 |
| 8,509,667 | B2 | 8/2013 | Miyauchi | |
| 2004/0151522 | A1* | 8/2004 | Kato et al. | 399/328 |
| 2009/0175645 | A1* | 7/2009 | Seol et al. | 399/69 |
| 2011/0150543 | A1* | 6/2011 | Fujiwara et al. | 399/328 |
| 2012/0051809 | A1 | 3/2012 | Miyauchi | |
| 2012/0230742 | A1* | 9/2012 | Nakagawa et al. | 399/329 |
| 2013/0315640 | A1 | 11/2013 | Miyauchi | |

FOREIGN PATENT DOCUMENTS

JP 2012-053105 A 3/2012

* cited by examiner

*Primary Examiner* — Quana M Grainger
(74) *Attorney, Agent, or Firm* — Banner & Witcoff, Ltd.

(57) ABSTRACT

A fixing device includes: an endless fusing belt; a heater; a nip member; and a backup member. The endless fusing belt is configured to circularly move in a moving direction. The endless fusing belt has widthwise ends in a widthwise direction. The backup member is configured to nip the endless fusing belt in cooperation with the nip member. The nip member includes: a base portion having a contact surface; and protruding portions respectively provided at positions outside the widthwise ends of the endless fusing belt in the widthwise direction and protruding toward the backup member relative to the contact surface.

19 Claims, 11 Drawing Sheets

FIXING DEVICE CAPABLE OF RETAINING LUBRICANT BETWEEN NIP MEMBER AND FUSING BELT

CROSS REFERENCE TO RELATED APPLICATION

This application claims priority from Japanese Patent Application No. 2013-206763 filed Oct. 1, 2013. The entire content of the priority application is incorporated herein by reference.

TECHNICAL FIELD

The present invention relates to a fixing device for thermally fixing a developer image onto a recording sheet.

BACKGROUND

There is conventionally known a fixing device for thermally fixing a developer image to a recording sheet such as paper. One such fixing device is provided with an endless fusing belt, a nip member disposed inside a loop formed by the fusing belt, and a backup member such as a pressure roller that pinches the fusing belt in cooperation with the nip member. In order to improve sliding characteristics between the nip member and the circulating fusing belt in the fixing device having this construction, lubricant is provided between the fusing belt and the nip member.

SUMMARY

However, since the fusing belt is pinched between the nip member and the backup member, a degree of pressing force is constantly applied to the lubricant between the nip member and the fusing belt. This pressure can cause the lubricant to migrate toward edges of the fusing belt and leak out from between the nip member and the fusing belt.

In view of the foregoing, it is an object of the present invention to provide a fixing device capable of retaining lubricant between a nip member and a fusing belt.

In order to attain the above and other objects, the present invention provides a fixing device that may include: an endless fusing belt; a heater; a nip member; and a backup member. The endless fusing belt may be configured to circularly move in a moving direction. The endless fusing belt may have widthwise ends in a widthwise direction. The backup member may be configured to nip the endless fusing belt in cooperation with the nip member. The nip member may include: a base portion having a contact surface; and protruding portions respectively provided at positions outside the widthwise ends of the endless fusing belt in the widthwise direction and protruding toward the backup member relative to the contact surface.

According to another aspect, the present invention provides a fixing device that may include: an endless fusing belt; a heater; a nip member; and a backup member. The endless fusing belt may be configured to circularly move in a moving direction. The endless fusing belt may have widthwise ends in a widthwise direction and an inner circumferential surface defining an internal space. The endless fusing belt may have a generally circular cross-section taken along a plane perpendicular to the widthwise direction to provide a radial direction. The heater may extend through the internal space and be configured to generate heat in the internal space. The nip member may extend through the internal space. The nip member may include: a contact surface configured to contact the inner circumferential surface through a lubricant; and protruding portions respectively provided at positions outside the widthwise ends of the endless fusing belt in the widthwise direction and protruding outward of the contact surface in the radial direction. The backup member may be configured to nip the endless fusing belt in cooperation with the nip member.

DETAILED DESCRIPTION

[First Embodiment]

Figure 1:
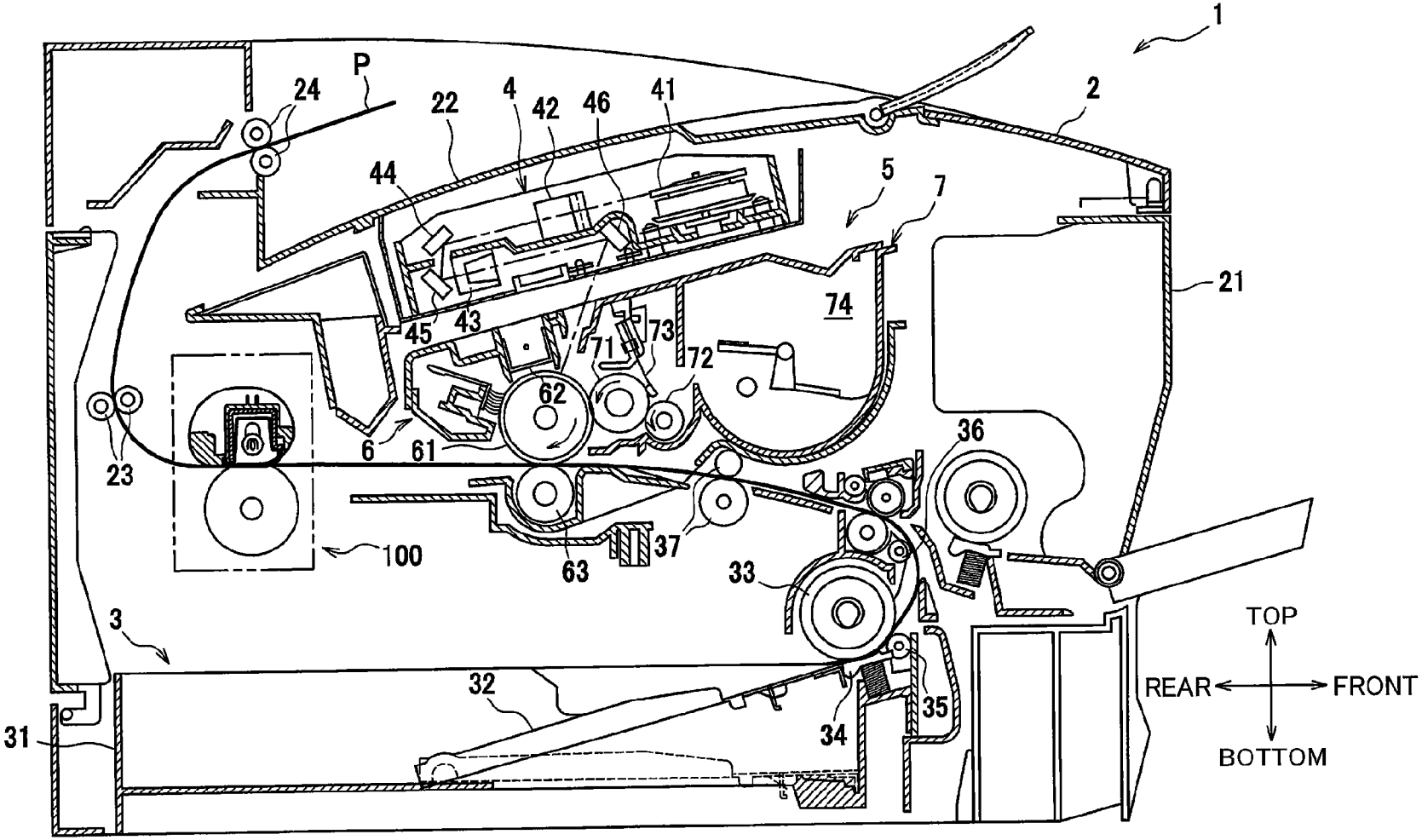
FIG. 1 is a cross-sectional view of a laser printer provided with a fixing device according to a first embodiment of the present invention.

A laser printer 1 provided with a fixing device 100 according to a first embodiment of the present invention will be described with reference to FIG. 1. A detailed structure of the fixing device 100 will be described later with reference to FIGS. 2 through 5, wherein like parts and components are designated by the same reference numerals to avoid duplicating description.

In the following description, the terms "upward", "downward", "upper", "lower", "above", "below", "beneath", "right", "left", "front", "rear" and the like will be used assuming that the laser printer 1 is disposed in an orientation in which it is intended to be used. In use, the laser printer 1 is disposed as illustrated in FIG. 1, in which a left side and a right side in FIG. 1 are a rear side and a front side, respectively; a far side and a near side in FIG. 1 are a right side and a left side, respectively; a top side and a bottom side in FIG. 1 are a top side and a bottom side, respectively.

<Overall Structure of Laser Printer>

As illustrated in FIG. 1, the laser printer 1 includes a frame 2 in which a sheet supply unit 3 configured to supply sheets (recording sheet) P, an exposure unit 4, a process cartridge 5 configured to transfer a toner image onto the sheet P, and a fixing device 100 configured to thermally fix the toner image to the sheet P are accommodated. The frame 2 has an opening opened and closed by a front cover 21.

The sheet supply unit 3 is positioned at a lower internal portion of the frame 2. The sheet supply unit 3 includes a sheet supply tray 31 for accommodating a stack of sheets P, a lifter plate 32 configured to lift a leading end portion of the sheet P, a sheet supply roller 33, a sheet supply pad 34, a paper dust removing rollers 35, 36, and registration rollers 37. The sheets P stacked on the sheet supply tray 31 are urged toward the sheet supply roller 33 by the lifter plate 32, and each sheet P is separated from the sheet stack by the sheet supply roller 33 and the sheet supply pad 34, and is conveyed toward the process cartridge 5 through the paper dust removing rollers 35, 36 and the registration rollers 37.

The exposure unit 4 is positioned at an upper internal portion of the frame 2. The exposure unit 4 includes a laser emitting portion (not illustrated), a rotationally driven polygon mirror 41, lenses 42, 43 and reflection mirrors 44, 45, 46. Laser beam (indicated by a dashed line in FIG. 1) based on image data is emitted from the laser emitting portion and is scanned at high speed on an outer peripheral surface of a photosensitive drum 61 of the process cartridge 5 by way of the polygon mirror 41, the lens 42, the reflection mirrors 44, 45, the lens 43 and the reflection mirror 46 in this order.

The process cartridge 5 is positioned below the exposure unit 4. The process cartridge 5 is attachable to and detachable from the frame 2 through the opening when the front cover 21 is open. The process cartridge 5 includes a drum unit 6 and a developing unit 7.

The drum unit 6 includes the photosensitive drum 61, a charger 62, and a transfer roller 63. The developing unit 7 is attachable to and detachable from the drum unit 6. The developing unit 7 includes a developing roller 71, a supply roller 72, a layer thickness regulation blade 73, and a toner accommodating portion 74 for accommodating therein toner.

In the process cartridge 5, an electrostatic latent image corresponding to the image data is formed on the outer peripheral surface of the photosensitive drum 61 upon exposure to high speed scanning of the laser beam emitted from the exposure unit 4 after the outer peripheral surface is uniformly charged by the charger 62. Toner in the toner accommodating portion 74 is supplied to the developing roller 71 through the supply roller 72, and is entered into a gap between the developing roller 71 and the layer thickness regulation blade 73 to provide a thin toner layer having a uniform thickness on the developing roller 71.

The toner carried on the developing roller 71 is then supplied to the electrostatic latent image formed on the outer peripheral surface of the photosensitive drum 61. Thus, a visible toner image corresponding to the electrostatic latent image is formed on the outer peripheral surface of the photosensitive drum 61. Then, the toner image carried on the outer peripheral surface of the photosensitive drum 61 is transferred onto the sheet P when the sheet P is moved through a gap between the photosensitive drum 61 and the transfer roller 63.

The fixing unit 100 is positioned rearward of the process cartridge 5. The toner image transferred onto the sheet P is thermally fixed to the sheet P while the sheet P passes through the fixing unit 100. The sheet P is then discharged onto a discharge tray 22 through conveyer rollers 23, 24.

<Detailed Structure of Fixing Device>

Figure 2:
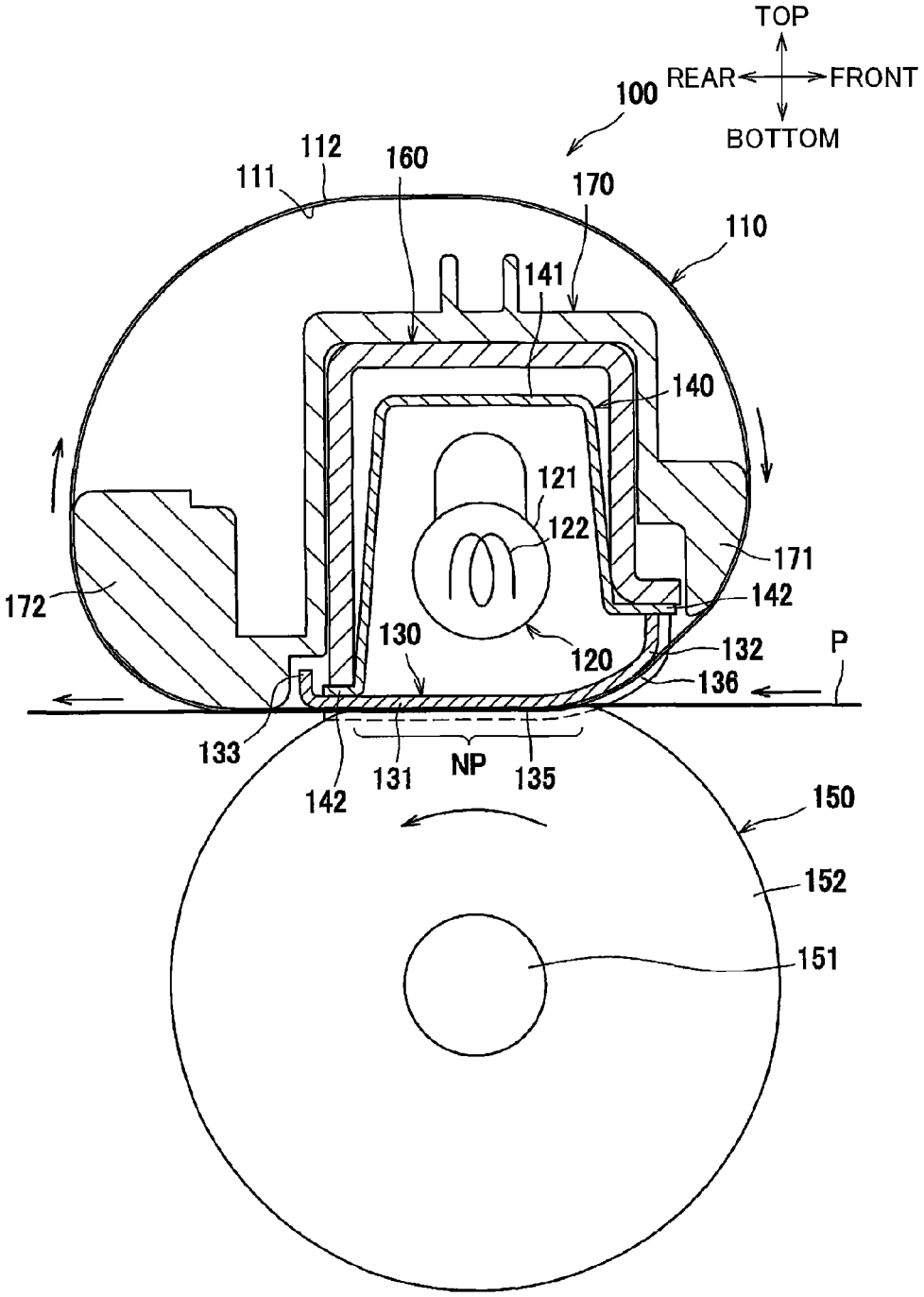
FIG. 2 is a cross-sectional view of the fixing device according to the first embodiment taken along a plane perpendicular to a left-right direction.

As illustrated in FIG. 2, the fixing device 100 includes a fusing belt 110, a halogen lamp 120 as an example of a heater, a nip plate 130 as an example of a nip member, a reflecting member 140, a pressure roller 150 as an example of a backup member, a stay 160, and a frame member 170.

The fusing belt 110 is an endless belt having heat resistivity and flexibility. The fusing belt 110 is configured of a tube formed of a metal such as stainless steel, and a coating layer such as fluorine resin formed on an outer periphral surface of the metal tube. The fusing belt 110 is disposed so as to be capable of circulating clockwise in FIG. 2 while being guided by inner circumferential guides 171 and 172 (described later) provided on the frame member 170 such that its portion between the nip plate 130 and the pressure roller 150 moves rearward. As the fusing belt 110 circulates, an inner circumferential surface 111 of the fusing belt 110 slides over the nip plate 130, and an outer circumferential surface 112 of the fusing belt 110 contacts the pressure roller 150 (or a sheet P).

The halogen lamp 120 is a heater that heats the nip plate 130 and the fusing belt 110 in order to heat toner transferred onto the sheet P. The halogen lamp 120 is disposed in an internal space defined by the inner circumferential surface 111 of the fusing belt 110 while being spaced apart at a prescribed distance from the inner circumferential surface 111 of the fusing belt 110. The halogen lamp 120 includes a glass tube 121 elongated in the left-right direction, and a filament 122 wound in a spiral configuration and disposed inside the glass tube 121. The halogen lamp 120 is configured to generate heat in the internal space of the fusing belt 110 by conducting electricity to the filament 122.

The nip plate 130 is a plate-like member that receives radiant heat from the halogen lamp 120. The nip plate 130 is disposed in the internal space of the fusing belt 110 so as to be spaced apart at a prescribed distance from the halogen lamp 120 and to contact the inner circumferential surface 111 of the fusing belt 110. The nip plate 130 includes a base portion 131 having a general flat plate shape, a curved portion 132 that extends forward from a front edge of the base portion 131 while curving upward, and a bent portion 133 that extends upward from a rear edge of the base portion 131. The nip plate 130 is configured to transfer the radiant heat received from the halogen lamp 120 to the toner on the sheet P via the fusing belt 110 and is, to this effect, formed of a metal plate such as an aluminum plate having thermal conductivity greater than that of the stay 160 (described later) made of steel. The surface of the nip plate 130 may be coated with a metal oxide film, fluororesin film, or the like. A detailed structure of the nip plate 130 will be described later.

The reflecting member 140 is a member that reflects the radiant heat from the halogen lamp 120 toward the nip plate 130. The reflecting member 140 is disposed in the internal space of the fusing belt 110 so as to surround the halogen lamp 120 while being spaced apart at a prescribed distance therefrom. The reflecting member 140 is formed by bending an aluminum plate or the like having a high reflection ratio regarding an infrared ray and a far-infrared ray. Specifically, the reflecting member 140 includes a reflecting portion 141 having a general U-shape in cross-section, and flange portions 142 extending outward in a front-rear direction from respective ends of the reflecting portion 141. Here, the aluminum plate or the like constituting the reflecting member 140 may be given mirror-surface finishing to enhance heat reflectivity.

The pressure roller 150 is disposed below the nip plate 130 so as to nip the fusing belt 110 in cooperation with the nip plate 130. The pressure roller 150 is configured to convey the sheet P between the nip plate 130 and itself, with the fusing belt 110 interposed between the nip plate 130 and the sheet P. The pressure roller 150 includes a metal shaft 151, and an elastic roller body 152 provided around a circumferential surface of the metal shaft 151. A portion of the roller body 152 contacting the nip plate 130 with the fusing belt 110 interposed therebetween elastically deforms to form a nip region NP with the fusing belt 110. Note that the pressure roller 150 and the nip plate 130 are disposed such that one of the pressure roller 150 and the nip plate 130 applies pressure to the other.

A motor (not illustrated) provided in the frame 2 transmits a drive force to the pressure roller 150 for driving the pressure roller 150 to rotate. The fusing belt 110 circulates in association with the rotation of the pressure roller 150 owing to a frictional force generated between the fusing belt 110 (or sheet P) and the pressure roller 150. After the toner image has been transferred onto the sheet P, the sheet P is conveyed between the pressure roller 150 and the heated fusing belt 110 to thermally fix the toner image.

The stay 160 supports the nip plate 130 through the flange portions 142 of the reflecting member 140 in order to maintain rigidity of the nip plate 130 to which a load from the pressure roller 150 is applied. The stay 160 is disposed in the internal space of the fusing belt 110 and arranged to surround the reflecting member 140. The stay 160 has a general U-shape in cross-section so as to conform an outer shape of the reflecting member 140 (reflecting portion 141). The stay 160 is formed by bending a steel plate or other member having relatively high rigidity.

The frame member 170 supports left and right ends of the halogen lamp 120, the stay 160, and the like. The frame member 170 is disposed in the internal space of the fusing belt 110 and arranged to surround the stay 160. The frame member 170 is fixed to the stay 160. The frame member 170 is formed of a heat resistive resin material or the like. The frame member 170 includes the inner circumferential guides 171, 172 for guiding circulation of the fusing belt 110.

<Detailed Structure of Nip Plate>

Figure 3:
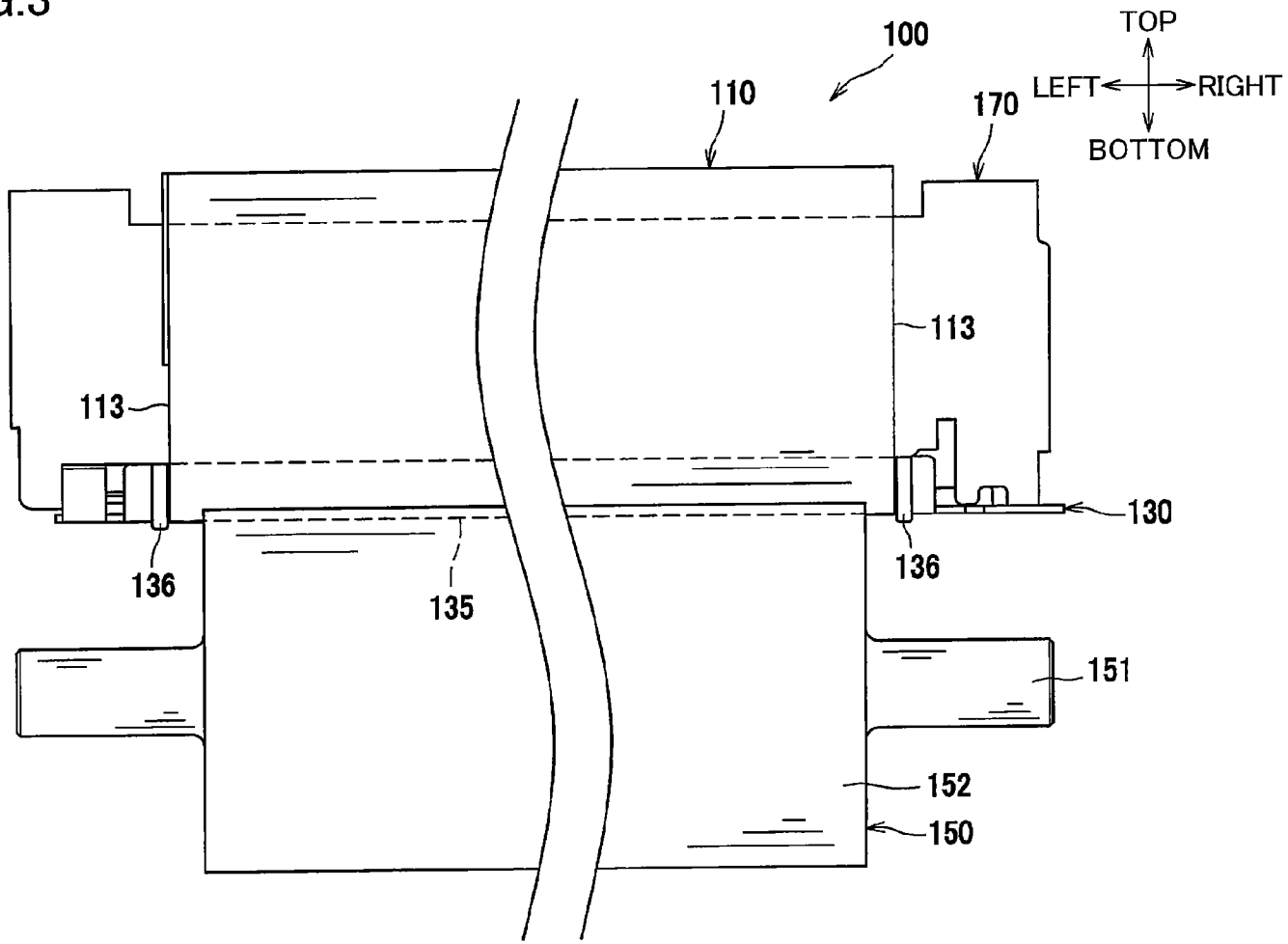
FIG. 3 is a front view of the fixing device according to the first embodiment.

As illustrated in FIGS. 2 and 3, the nip plate 130 includes the base portion 131 having a contact surface 135 that is brought into sliding contact with the inner circumferential surface 111 of the circulating fusing belt 110, and protruding portions 136 respectively provided on left and right sides of the contact surface 135.

The contact surface 135 is a surface of the nip plate 130 confronting the fusing belt 110 and spans across the base portion 131 to an approximate center region of the curved portion 132. Grease G (see FIG. 5) as an example of a lubricant is provided between the contact surface 135 and the inner circumferential surface 111 of the fusing belt 110 for enhancing sliding characteristics of the contact surface 135 and the inner circumferential surface 111 of the fusing belt 110. Providing the grease G in this way enables the inner circumferential surface 111 of the fusing belt 110 to slide in contact with the contact surface 135.

Figure 4:
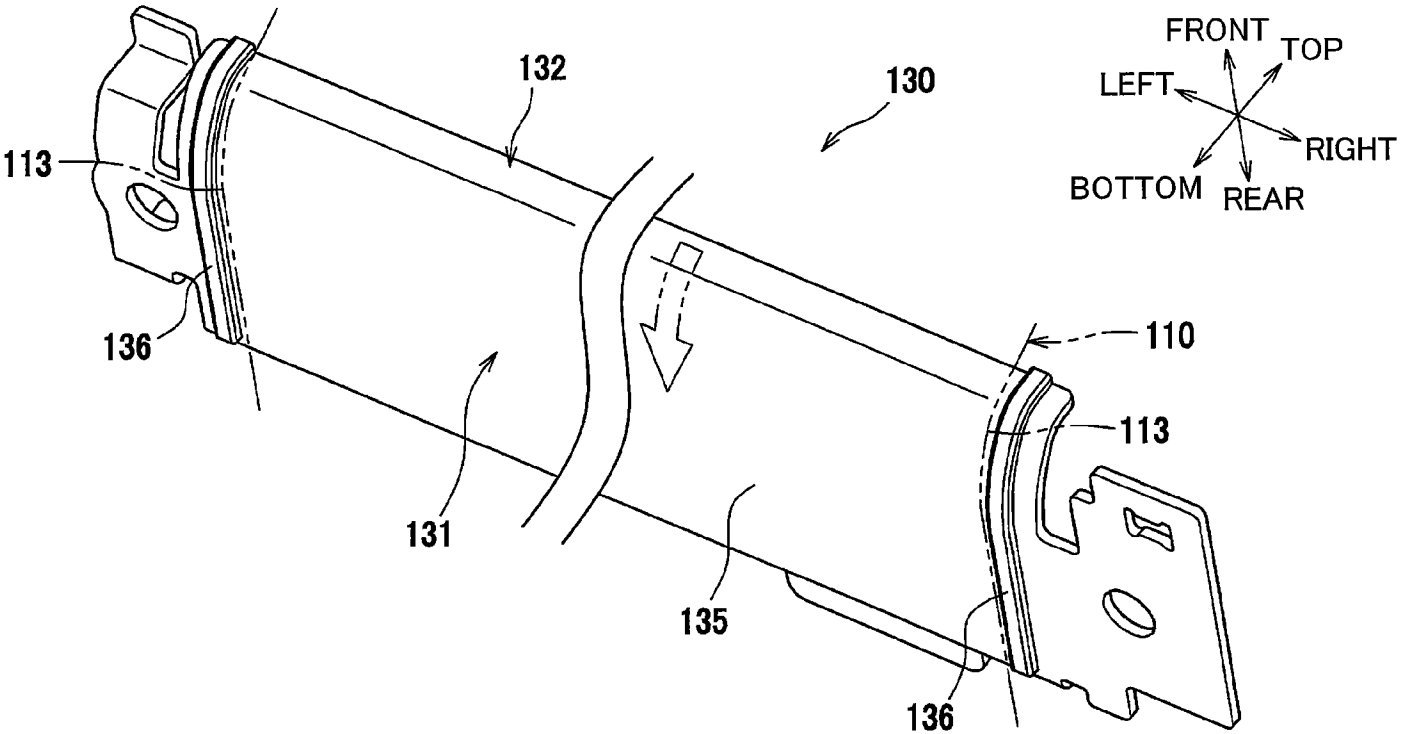
FIG. 4 is a perspective view of a nip plate in the fixing device according to the first embodiment as viewed from a side on which a contact surface of the nip plate is disposed.

As illustrated in FIG. 4, the protruding portions 136 are respectively provided at positions outside ends 113 of the fusing belt 110. The protruding portions 136 are shaped to protrude farther toward the fusing belt 110 (the pressure roller 150) than the contact surface 135. In this embodiment, the protruding portions 136 are integrally formed with the base portion 131 so as to constitute part of the nip plate 130 when the nip plate 130 is manufactured. The nip plate 130 is produced by stamping a metal plate.

More specifically, the protruding portions 136 protrude outward in a radial direction of the fusing belt 110 from positions on the left and right sides of the contact surface 135, respectively. The protruding portions 136 protrude farther outward in the radial direction than the outer circumferential surface 112 of the fusing belt 110. The amount that the protruding portions 136 protrude from the contact surface 135 (a height H of the protruding portions 136 (see FIG. 5)) is preferably at least one-half the thickness of the fusing belt 110.

Further, the protruding portions 136 extend along a circulating direction (as an example of a moving direction) of the fusing belt 110 indicated by a dashed arrow in FIG. 4. More specifically, the protruding portions 136 are elongated along the circulating direction such that rear portions of the protruding portions 136 extend across the base portion 131 in the approximate front-rear direction, and front portions of the protruding portions 136 extend forward while curving upward along the curved portion 132.

Figure 5:
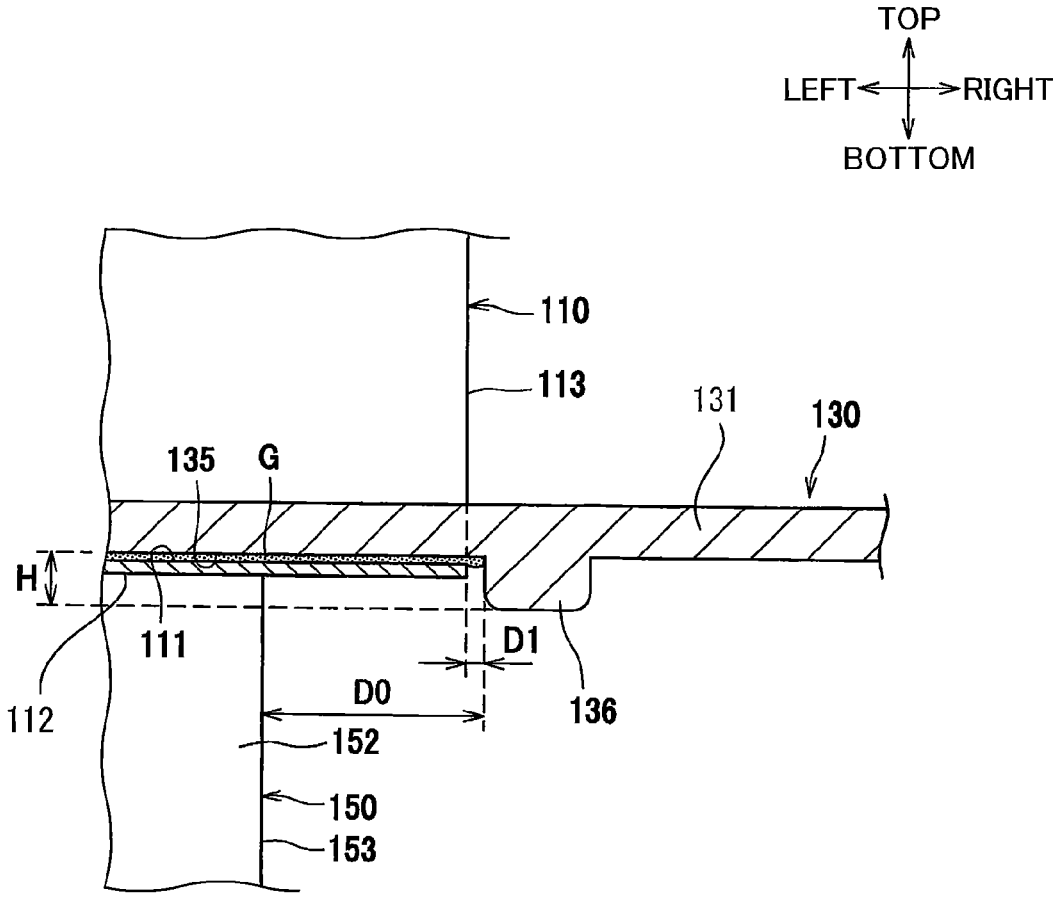
FIG. 5 is an enlarged cross-sectional view of one end portion of the nip plate in the fixing device according to the first embodiment taken along a plane perpendicular to a front-rear direction.

As illustrated in FIG. 5, the protruding portions 136 are disposed at positions for contacting the corresponding ends 113 of the fusing belt 110 if the fusing belt 110 were to move even slightly in left or right directions. A gap D1 formed between each end 113 of the fusing belt 110 and the corresponding protruding portion 136 is preferably no greater than 5 mm, and more preferably no greater than 3 mm. In other words, the difference between the distance between the left and right protruding portions 136 and the width of the fusing belt 110 (left-right dimension) is preferably no greater than 10 mm, and more preferably no greater than 6 mm. While there is no particular lower limit for the gap D1, provided that the fusing belt 110 is not inhibited from circulating, the lower limit could be set to approximately 0.2 mm, for example.

Note that the roller body 152 of the pressure roller 150 has a width smaller than that of the fusing belt 110 in this embodiment. A gap D0 between each end 153 of the roller body 152 and the corresponding protruding portion 136 is preferably no greater than 15 mm, and more preferably no greater than 8 mm. In other words, the difference between the distance between the left and right protruding portions 136 and the width of the pressure roller 150 (roller body 152) is preferably no greater than 30 mm, and more preferably no greater than 16 mm.

As an example, when the fusing belt 110 has a width of 238 mm and a thickness of 0.05 mm and the nip plate 130 (the portion with the contact surface 135) has a thickness of 0.6 mm, the height H of the protruding portions 136 can be set to 0.05-0.1 mm and the gap D1 between each end 113 of the fusing belt 110 and the corresponding protruding portion 136 can be set to 0.2-3.0 mm.

According to the first embodiment described above, the protruding portions 136 protruding farther outward than the contact surface 135 can restrict the grease G from leaking out from between the nip plate 130 and the fusing belt 110. Accordingly, this configuration retains the grease G between the nip plate 130 and the fusing belt 110.

In particular, since the protruding portions 136 of the first embodiment extend along the circulating direction of the fusing belt 110, as illustrated in FIGS. 2 and 4, the wall-like protruding portions 136 can reliably restrict outflow of the grease G. Hence, this configuration reliably retains the grease G between the nip plate 130 and the fusing belt 110.

Further, since the protruding portions 136 are disposed so as to be capable of contacting the ends 113 of the fusing belt 110, the gap D1 between each protruding portion 136 and the corresponding end 113 of the fusing belt 110 can be minimized. With this arrangement, the protruding portions 136 can reliably restrict leaking of the grease G, thereby reliably retaining the grease G between the nip plate 130 and the fusing belt 110. Further, when one of the ends 113 of the fusing belt 110 contacts the corresponding protruding portion 136, the protruding portion 136 can prevent further movement of the fusing belt 110 in its width direction (left-right direction). In other words, the protruding portions 136 can prevent the fusing belt 110 from drifting left and right.

Further, since the protruding portions 136 are integrally formed on the nip plate 130, that is, integrally formed with the base portion 131, gaps through which the grease G can enter are not formed between the protruding portions 136 and the base portion 131 of the nip plate 130, in contrast to a structure that provides the protruding portions as separate components that are attached to the base portion of the nip plate. In this way, the protruding portions 136 can successfully restrict migration of the grease G.

[Second Embodiment]

A fixing device 200 according to a second embodiment of the present invention will be described while referring to FIGS. 6 and 7, wherein like parts and components are designated with the same reference numerals to avoid duplicating description.

Figure 6:
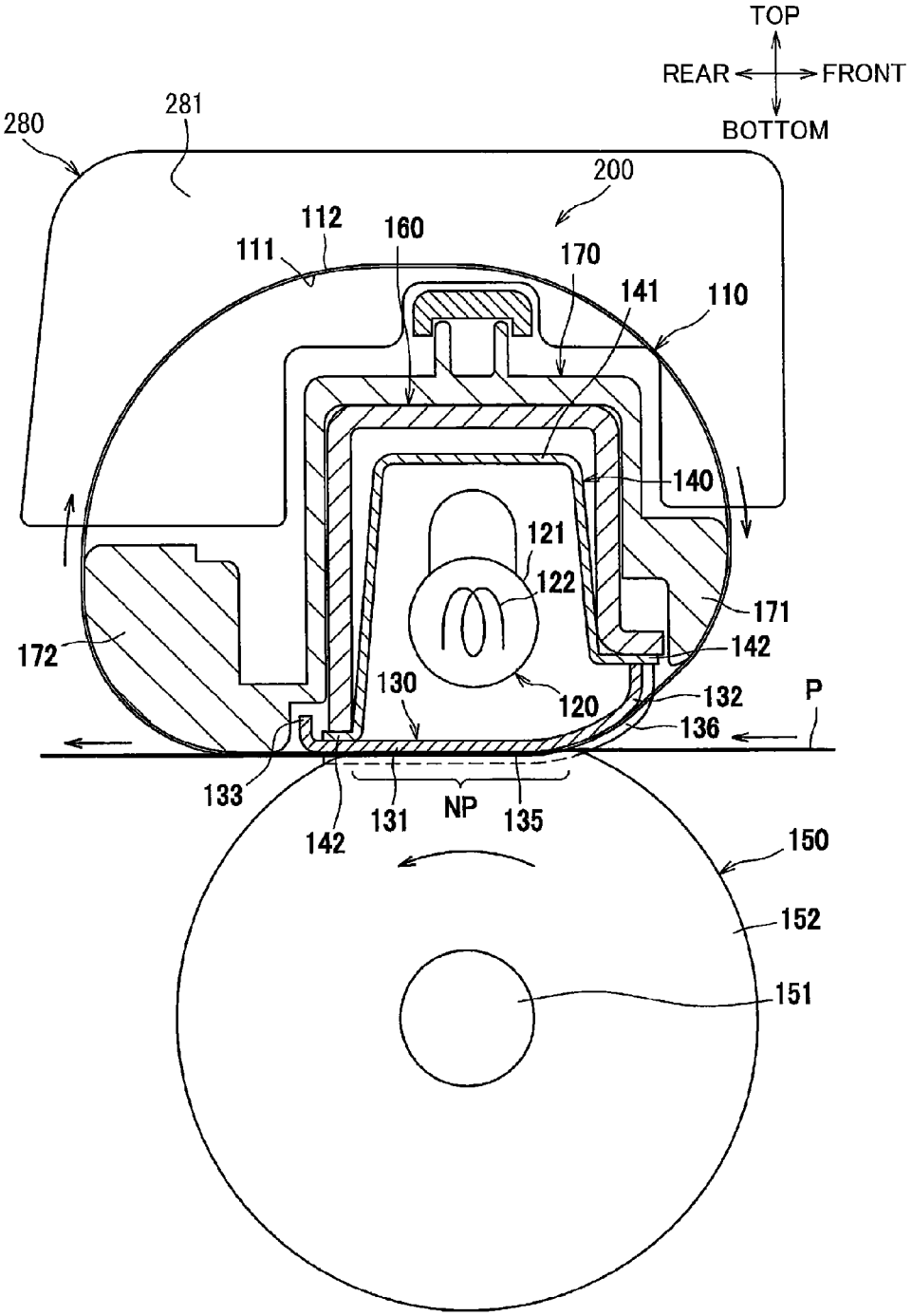
FIG. 6 is a cross-sectional view of a fixing device according to a second embodiment of the present invention taken along a plane perpendicular to the left-right direction.
Figure 7:
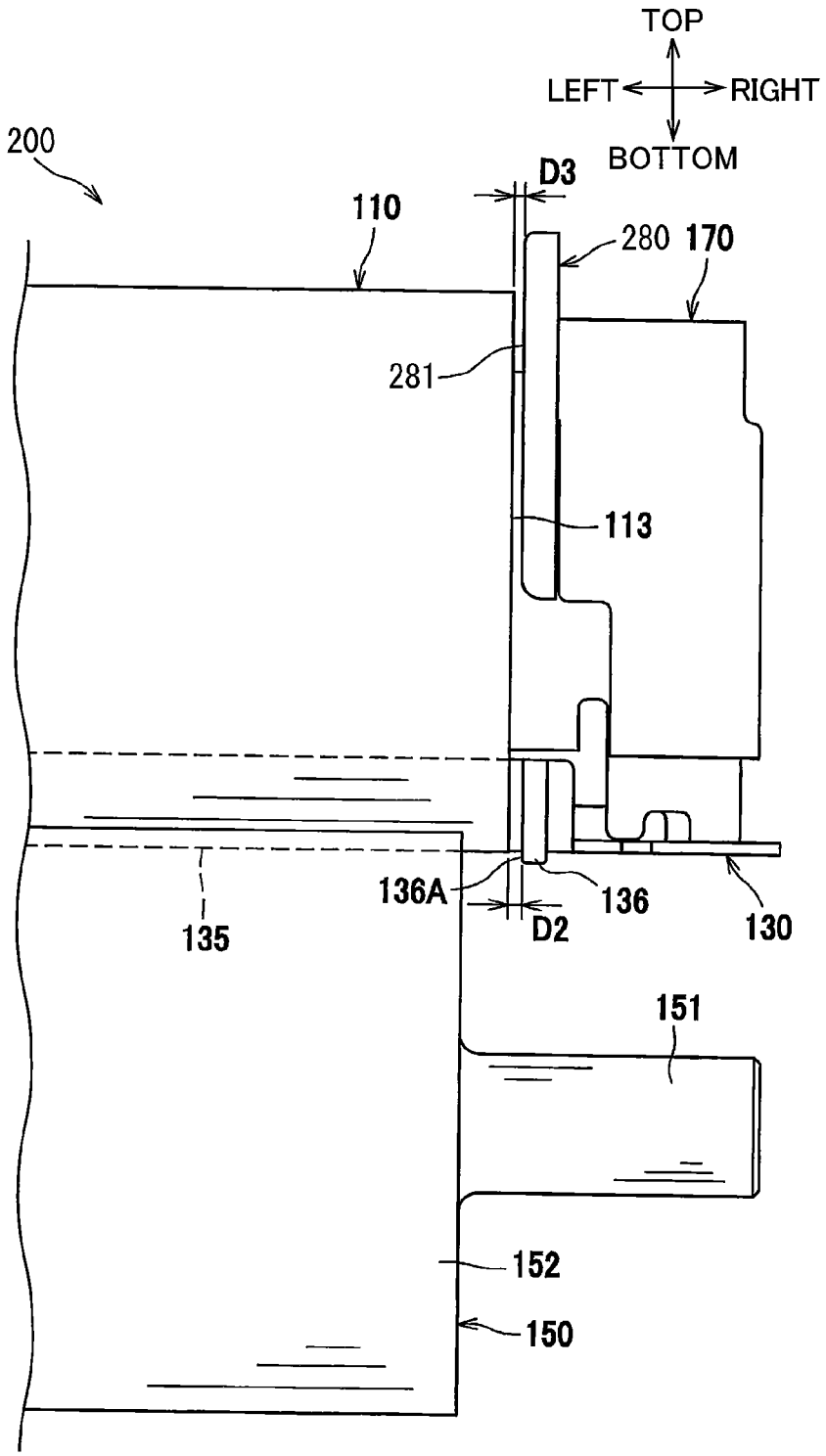
FIG. 7 is an enlarged front view of one end portion of the fixing device according to the second embodiment.

As illustrated in FIGS. 6 and 7, the fixing device 200 includes the fusing belt 110, the halogen lamp 120, the nip plate 130, the reflecting member 140, the pressure roller 150, the stay 160, the frame member 170, and restricting members 280.

The restricting members 280 serve to restrict movement of the fusing belt 110 in the left-right direction. The restricting members 280 are attached to the frame member 170, with one disposed on each of the left and right sides of the fusing belt 110 (only one is illustrated in the drawings). The restricting members 280 are formed of a resin, such as a polyphenylene sulfide (PPS) polymer, and are plate-like members having a general U-shape. An inner left-right surface of each restricting member 280 constitutes a restricting surface 281 that is capable of contacting the corresponding end 113 of the fusing belt 110. Note that the restricting members 280 may also be integrally formed with the frame member 170.

The protruding portions 136 of the nip plate 130 are respectively provided on the left and right sides of the contact surface 135 (only one is illustrated in the drawings). An inner left-right surface of each protruding portion 136 constitutes an inner endface 136A that is at the same position or farther outside of the corresponding restricting surface 281 in the left-right direction. More specifically, a gap D2 between the end 113 of the fusing belt 110 and the inner endface 136A of the corresponding protruding portion 136 is greater than or equal to a gap D3 between the same end 113 of the fusing belt 110 and the corresponding restricting surface 281.

The gap D3 is preferably no greater than 5 mm, and more preferably no greater than 1 mm. In other words, the difference between the distance between the left and right restricting surfaces 281 and the width of the fusing belt 110 is preferably no greater than 10 mm, and more preferably no greater than 2 mm. While there is no particular lower limit for the gap D3, provided that the fusing belt 110 is not inhibited from circulating, the lower limit could be set to approximately 0.2 mm, for example.

As described above, the gap D2 must be at least as large as the gap D3 (D2>D3). For example, when the gap D3 between the end 113 of the fusing belt 110 and the corresponding restricting surface 281 is set to 5 mm, the gap D2 between the same end 113 of the fusing belt 110 and the inner endface 136A of the corresponding protruding portion 136 can be set within the range 5-6 mm. Further, when the gap D3 is 1 mm, the gap D2 can be set to 2 mm, for example.

According to the second embodiment described above, as in the first embodiment described earlier, the protruding portions 136 can restrict the outflow of the grease G, thereby retaining the grease G between the nip plate 130 and the fusing belt 110.

Further, the restricting members 280 in the second embodiment can restrict the fusing belt 110 from drifting left and right. Further, since the inner endfaces 136A of the protruding portions 136 are at the same position or further outside of the corresponding restricting surfaces 281 in the left-right direction, i.e., since the inner endfaces 136A of the protruding portions 136 are not disposed on the fusing belt 110 side of the corresponding restricting surfaces 281, the protruding portions 136 are able to retain the grease G between the nip plate 130 and the fusing belt 110 without hindering the function of the restricting members 280.

[Third Embodiment]

A fixing device 300 according to a third embodiment of the present invention will be described while referring to FIGS. 8A and 8B, wherein like parts and components are designated with the same reference numerals to avoid duplicating description.

Figure 8A:
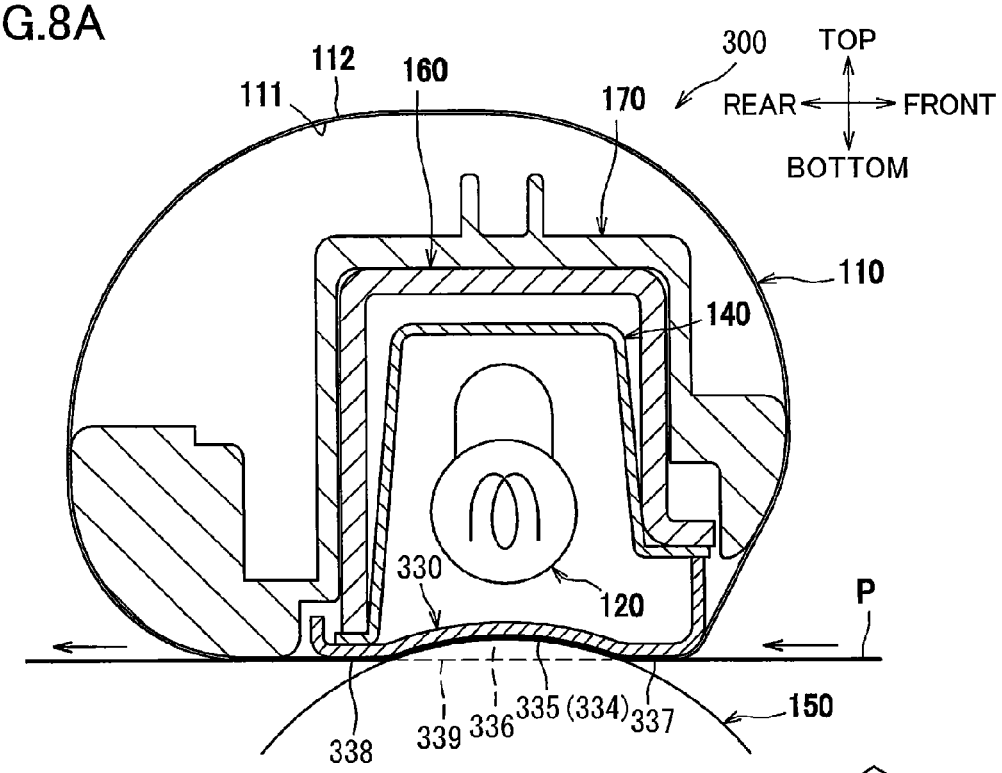
FIG. 8A is a cross-sectional view of a fixing device according to a third embodiment of the present invention taken along a plane perpendicular to the left-right direction.
Figure 8B:
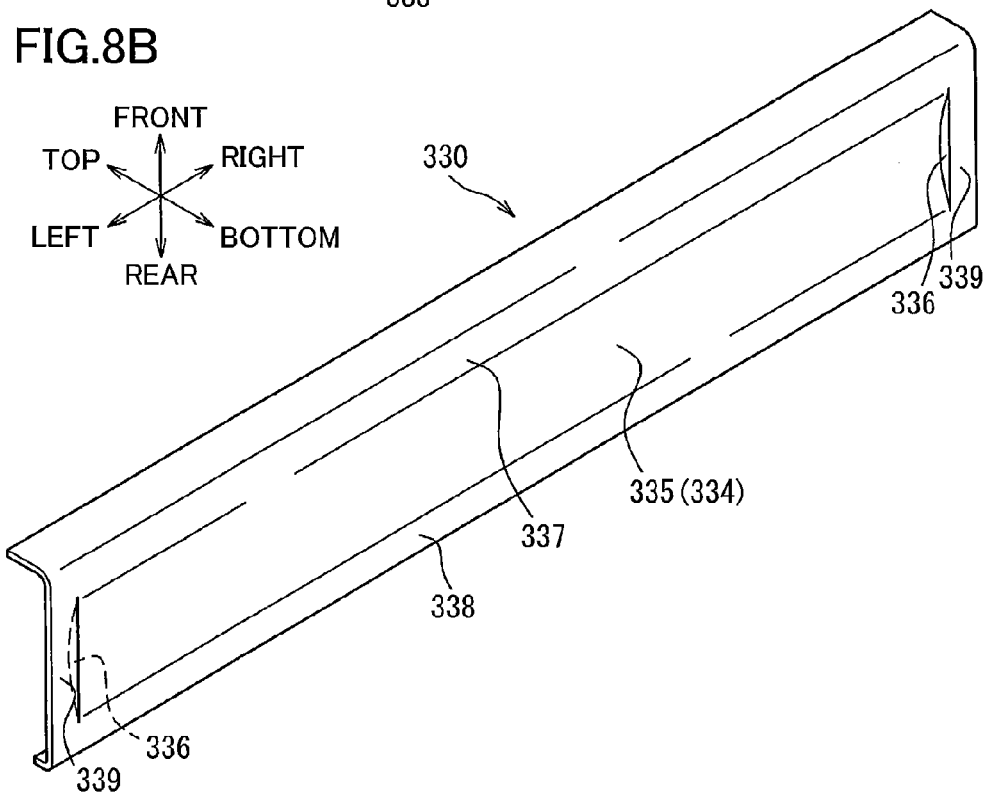
FIG. 8B is a perspective view of a nip plate in the fixing device according to the third embodiment as viewed from a side on which a contact surface of the nip plate is disposed.

As illustrated in FIGS. 8A and 8B, the fixing device 300 includes the fusing belt 110, the halogen lamp 120, a nip plate 330, the reflecting member 140, the pressure roller 150, the stay 160, and the frame member 170.

The nip plate 330 has a surface confronting the pressure roller 150 through the fusing belt 110, and the surface has a portion constituting a concave surface 334 having a curved shape as viewed in the left-right direction (along the width direction of the fusing belt 110). The concave surface 334 is recessed upward from the side on which the pressure roller 150 is disposed toward the side on which the halogen lamp 120 is disposed to form a general arcuate shape in cross-section that substantially conforms to an outer circumferential surface of the pressure roller 150. The concave surface 334 serves as a contact surface 335 that is brought into sliding contact with the inner circumferential surface 111 of the circulating fusing belt 110.

The nip plate 330 also includes protruding portions 336 respectively provided on left and right ends of the contact surface 335 (concave surface 334). The protruding portions 336 protrude farther toward the fusing belt 110 (the pressure roller 150) than the contact surface 335.

More specifically, the nip plate 330 has a front flat surface 337 extending forward from a front edge of the concave surface 334, a rear flat surface 338 extending rearward from a rear edge of the concave surface 334, and side flat surfaces 339 disposed on left and right sides of the concave surface 334. The front flat surface 337, the rear flat surface 338, and the side flat surfaces 339 occupy the same plane and form in combination a frame around the concave surface 334 having substantially parallel front and rear components and substantially parallel left and right components.

The protruding portions 336 connect the left and right edges of the concave surface 334 with the corresponding side flat surfaces 339 and have surfaces extending in a direction substantially orthogonal to the side flat surfaces 339. The left-right widths of the fusing belt 110 and the pressure roller 150 are shorter than the left-right dimension of the concave surface 334. The fusing belt 110 and the pressure roller 150 are inserted into a space surrounded by the concave surface 334 so that the protruding portions 336 confront the corresponding ends 113 of the fusing belt 110.

According to the third embodiment described above, as in the first and second embodiments described earlier, the protruding portions 336 protruding farther toward the fusing belt 110 than the contact surface 335 can restrict the outflow of the grease G from between the nip plate 330 and the fusing belt 110, thereby retaining the grease G between the nip plate 330 and the fusing belt 110.

Further, since the contact surface 335 has a curved concave shape, the grease G can be more easily retained between the recessed contact surface 335 and the fusing belt 110 than when the contact surface is flat.

Note that the protruding portions 336 may also be provided to protrude father toward the fusing belt 110 than the front flat surface 337 and the rear flat surface 338 in the third embodiment. Further, while substantially the entire concave surface 334 constitutes the contact surface 335 in the third embodiment, the present invention is not limited to this configuration. For example, when referring to FIG. 8A, if the concave surface 334 has a curvature smaller than that of the outer circumferential surface of the pressure roller 150, the contact surface 335 may constitute a portion of the concave surface 334.

[Modifications]

Various modifications and variations are conceivable. In the following description, only parts differing from those of the first to third embodiments will be described in detail.

Figure 9:
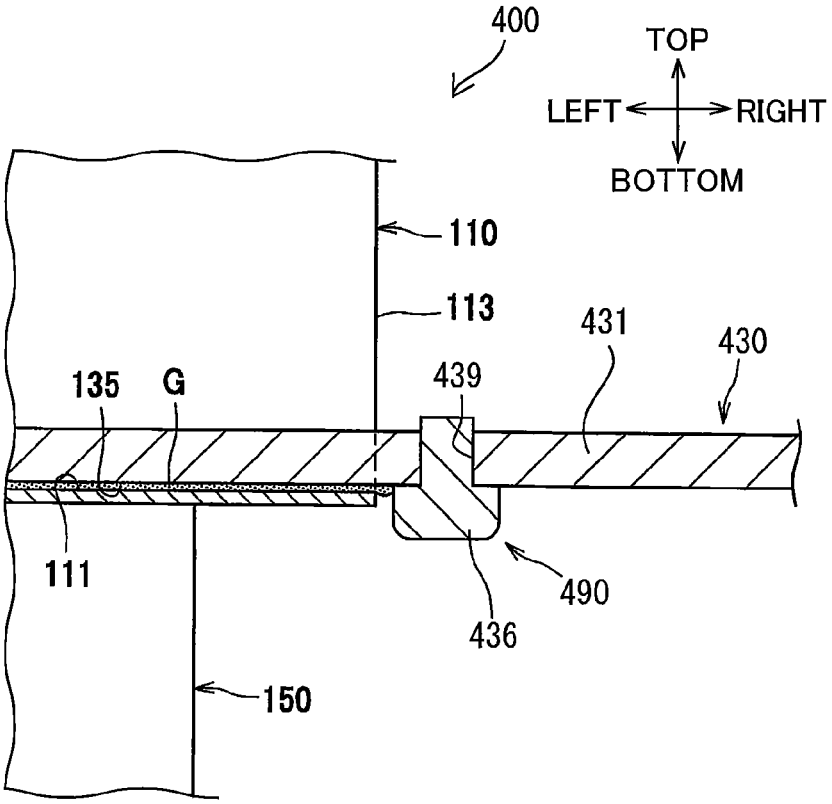
FIG. 9 is an enlarged cross-sectional view of one end portion of a nip plate in a fixing device according to a first modification taken along a plane perpendicular to the front-rear direction.

In the embodiments described above, the protruding portions 136 are integrally formed with the base portion 131 and constitute part of the nip plate 130. However, the protruding portions 136 may be provided as separate components from the nip plate 130. For example, as illustrated in FIG. 9, in a fixing device 400 according to a first modification, a base portion 431 of a nip plate 430 is formed with holes 439 at positions on the left and right sides of the contact surface 135 of the nip plate 430, and protruding portions 436 are provided by fitting pin-shaped protruding-portion-forming members 490 into the holes 439 (only one of each member is illustrated in the drawing). Incidentally, protruding portions 436 configured from separate parts such as the protruding-portion-forming members 490 may be formed of a thermally resistant resin such as a PPS polymer.

While not illustrated in the drawing, such protruding portions may also be formed by fixing separate members to the nip plate 130 with adhesive or the like at positions on the left and right sides of the contact surface 135 of the nip plate 130.

Figure 10A:
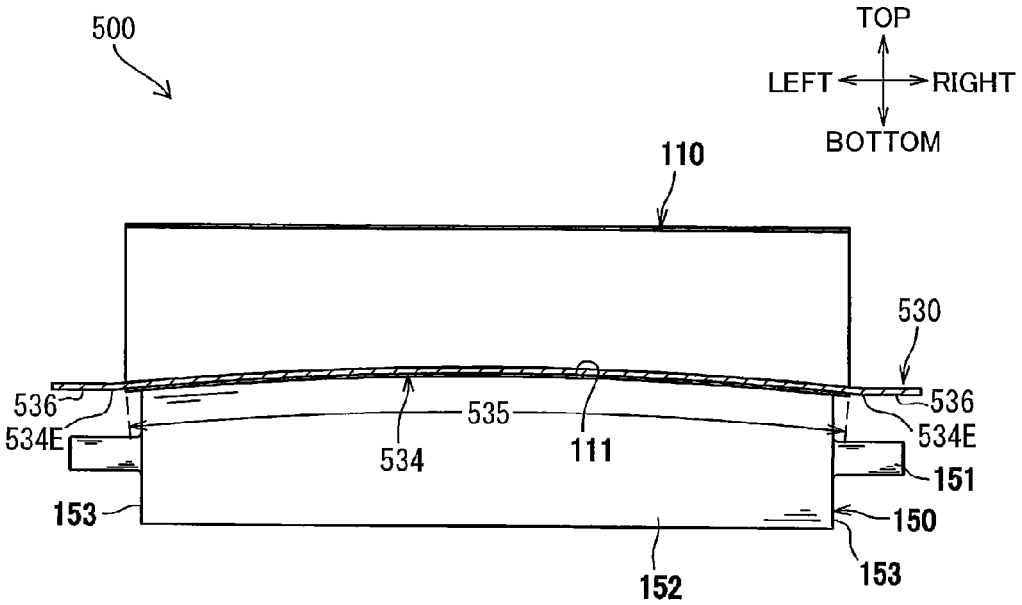
FIG. 10A is a cross-sectional view of a fixing device according to a second modification taken along a plane perpendicular to the front-rear direction.
Figure 10B:
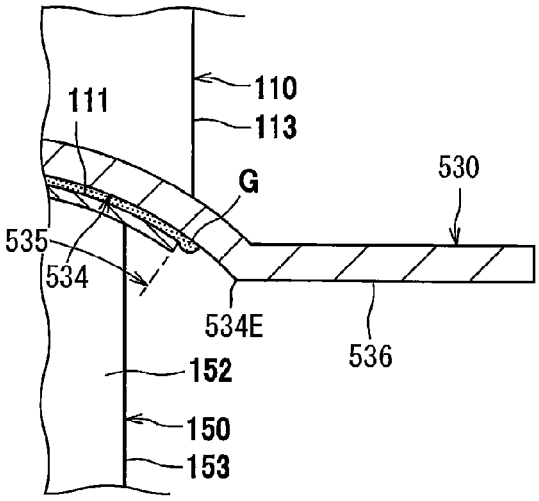
FIG. 10B is an enlarged cross-sectional view of one end portion of a nip plate in the fixing device according to the second modification.

In the third embodiment described above, the nip plate 330 has the concave surface 334 that curves to form a concave shape when viewed in the left-right direction. However, the present invention is not limited to this configuration. For example, as illustrated in FIG. 10A, in a fixing device 500 according to a second modification, a nip plate 530 has a concave surface 534 that curves to form a concave shape when viewed in the front-rear direction (i.e. sheet conveying direction). More specifically, as illustrated in FIGS. 10A and 10B, the nip plate 530 has a contact surface 535, and protruding portions 536. The contact surface 535 constitutes a portion of the concave surface 534 that is brought into sliding contact with the inner circumferential surface 111 of the circulating fusing belt 110 with the grease G interposed therebetween. The protruding portions 536 protrude farther toward the fusing belt 110 (the pressure roller 150) from the contact surface 535. The nip plate 530 applies pressure to the pressure roller 150 through the fusing belt 110. Further, the ends 153 of the roller body 152 of the pressure roller 150 are positioned inside of corresponding ends 534E of the concave surface 534 with respect to the left-right direction. In other words, the roller body 152 of the pressure roller 150 is formed to have a left-right dimension shorter than the concave surface 534.

With this construction, as in the first and other embodiments described earlier, the protruding portions 536 can restrict the outflow of the grease G, thereby retaining the grease G between the nip plate 530 and the fusing belt 110. This configuration also can ensure sufficient nip width between the contact surface 535 and the pressure roller 150, unlike a configuration in which the roller body of the pressure roller is longer than the concave surface.

Figure 11:
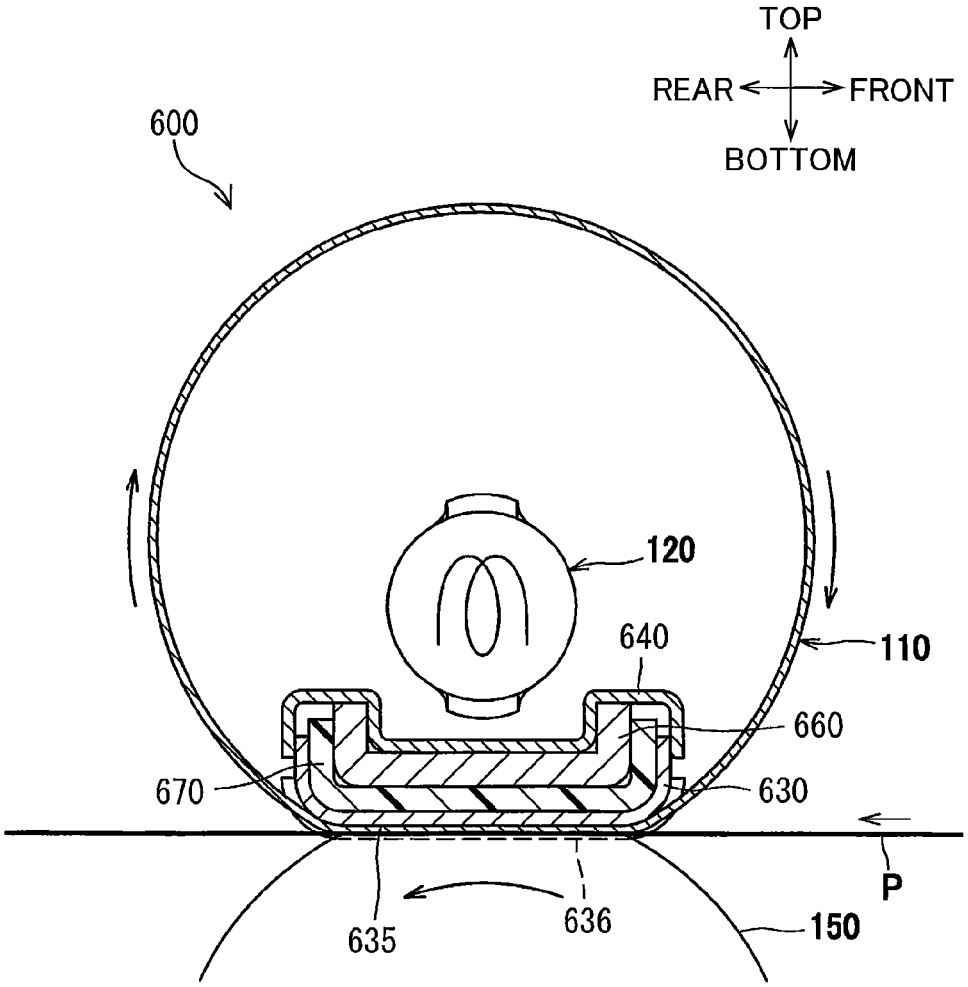
FIG. 11 is a cross-sectional view of a fixing device according to a third modification taken along a plane perpendicular to the left-right direction.

In the embodiments described above, the fixing device 100 is configured of the halogen lamp 120 that heats the nip plate 130 and that, through the heated nip plate 130, heats the fusing belt 110. However, the present invention is not limited to this configuration. For example, as illustrated in FIG. 11, a fixing device 600 according to a third modification is configured of the halogen lamp 120 that directly heats the fusing belt 110. Specifically, a nip plate 630 of the fixing device 600 is a plate-shaped member formed in a general U-shape in cross-section. The nip plate 630 is disposed in the internal space defined by the fusing belt 110 and is spaced apart from the halogen lamp 120. The nip plate 630 includes a contact surface 635 that is brought into sliding contact with the circulating fusing belt 110 with the grease G interposed therebetween, and a pair of left and right protruding portions 636 (only one is illustrated in the drawing) provided at positions outside the left and right ends 113 of the fusing belt 110. The protruding portions 636 protrude farther toward the fusing belt 110 (the pressure roller 150) than the contact surface 635. Disposed between the halogen lamp 120 and the nip plate 630 of the fixing device 600 are a reflecting member 640, a supporting member 660, and a heat insulating member 670. The reflecting member 640 is a member that reflects heat radiated from the halogen lamp 120 toward the fusing belt 110. The supporting member 660 is a member that supports the nip plate 630 and the reflecting member 640. The heat insulating member 670 is formed of a resin, such as a liquid-crystal polymer, to reduce direct transfer of heat from the halogen lamp 120 to the nip plate 630.

In the embodiments described above, the protruding portions 136 are formed to extend continuously along the circulating direction of the fusing belt 110. However, the present invention is not limited to this configuration. For example, the protruding portions 136 may be short rib-like components or boss-like components. A plurality of such protruding portions may be provided in a row along the circulating direction of the fusing belt 110. Since the grease G (lubricant) can get held up by these protruding portions in a sense, this configuration can also restrict the outflow of the grease G from between the nip member 130 and the fusing belt 110, thereby retaining the grease G between the nip member 130 and the fusing belt 110.

In the embodiments described above, the halogen lamp 120 serves as an example of a heater. However, the heater may be a carbon heater or the like, for example.

In the embodiments described above, the plate-shaped nip plate 130 serves as an example of a nip member. However, the nip member may have a thicker shape and is not limited to a plate-shaped member.

In the embodiments described above, the pressure roller 150 serves as an example of a backup member. However, the backup member may be a belt-shaped pressing member, for example.

In the embodiments described above, the fixing device 100 (200, 300) of the present invention is provided in the laser printer 1 that forms monochromatic images on sheets P. However, the image forming apparatus of the present invention may be a printer capable of forming color images on sheets of paper, for example. The image forming apparatus is also not limited to a printer, but may be a copying machine, multifunction peripheral, or the like provided with a document-reading device, such as a flatbed scanner, for example.

While the present invention has been described in detail with reference to the embodiment thereof, it would be apparent to those skilled in the art that various changes and modifications may be made therein without departing from the spirit of the present invention.

What is claimed is:

1. A fixing device comprising:

an endless fusing belt configured to circularly move in a moving direction, the endless fusing belt having widthwise ends in a widthwise direction and an inner peripheral surface;

a heater;

a nip member extending through an internal space of the endless fusing belt; and a backup member configured to nip the endless fusing belt in cooperation with the nip member, the nip member comprising:

an outer surface facing the inner peripheral surface of the endless fusing belt; and protruding portions respectively provided at positions outside the widthwise ends of the endless fusing belt in the widthwise direction and protruding toward the backup member relative to the outer surface of the nip member, wherein the outer surface of the nip member includes:

a contact surface in contact with the inner peripheral surface of the endless fusing belt through a lubricant and a non-contact surface out of contact with the inner peripheral surface of the endless fusing belt, the non-contact surface being positioned upstream relative to the contact surface in the moving direction, the non-contact surface being provided at a position inside the widthwise ends of the endless fusing belt in the widthwise direction, and wherein the protruding portions extends in the moving direction, a most upstream end of the protruding portions being positioned upstream relative to a most downstream end of the non-contact surface in the moving direction, and a most downstream end of the protruding portions being positioned downstream relative to a most upstream end of the contact surface in the moving direction.

2. The fixing device as claimed in claim 1, wherein each of the protruding portions is disposed at a position for contacting corresponding one of the widthwise ends of the endless fusing belt.

3. The fixing device as claimed in claim 1, further comprising restricting members respectively provided at positions outside the widthwise ends of the endless fusing belt in the widthwise direction, each of the restricting members having a restricting surface configured to contact corresponding one of the widthwise ends of the endless fusing belt, the restricting surfaces extending in a direction perpendicular to the widthwise direction, the restricting surface being entirely positioned outside the widthwise ends of the endless fusing belt in the widthwise direction, the restricting surfaces defining a first distance therebetween in the widthwise direction, wherein each of the protruding portions has an inner surface in the widthwise direction, the inner surface being disposed at a position outside the corresponding restricting surface in the widthwise direction, the inner surfaces of the protruding portions defining a second distance therebetween in the widthwise direction, the second distance being greater than the first distance.

4. The fixing device as claimed in claim 1, wherein the nip member is formed by stamping a single metal plate such that the protruding portions are formed integrally with the base portion.

5. A fixing device comprising:

an endless fusing belt configured to circularly move in a moving direction, the endless fusing belt having widthwise ends in a widthwise direction and an inner peripheral surface;

a heater;

a nip member; and a backup member configured to nip the endless fusing belt in cooperation with the nip member, the nip member comprising:

a contact surface in contact with the inner peripheral surface of the endless fusing belt, the contact surface having a widthwise center portion and widthwise end portions in the widthwise direction, the contact surface being curved as viewed in a direction in which a sheet is conveyed between the endless fusing belt and the backup member such that the widthwise center portion protruding toward the heater so as to be closer to the heater than the widthwise end portions to the heater; and protruding portions respectively provided at positions outside the widthwise ends of the endless fusing belt in the widthwise direction, the protruding portions having a planar shape extending in the widthwise direction.

6. The fixing device as claimed in claim 1, wherein the nip member further comprises:

a base portion providing a nip region in cooperation with the backup member for nipping the endless fusing belt therebetween, the base portion having an upstream end in the moving direction; and a curved portion extending from the upstream end of the base portion along the inner peripheral surface of the endless fusing belt, wherein the base portion and the curved portion provide the contact surface and are configured to receive radiant heat directly from the heater.

7. The fixing device as claimed in claim 1, wherein the nip member further comprises a base portion providing a nip region in cooperation with the backup member for nipping the endless fusing belt therebetween, the nip region having a downstream end in the moving direction, and wherein the protruding portions extend to positions downstream of the downstream end of the nip region in the moving direction.

8. The fixing device as claimed in claim 1, wherein the backup member includes a roller body having a widthwise length in the widthwise direction, and wherein each of the protruding portions has an inner surface in the widthwise direction, the inner surfaces of the protruding portions defining a distance therebetween in the widthwise direction, the distance being greater than the widthwise length.

9. The fixing device as claimed in claim 1, wherein the endless fusing belt has a generally circular cross-section taken along a plane perpendicular to the widthwise direction to provide a radial direction, wherein the endless fusing belt has an outer circumferential surface, and wherein the protruding portions protrude outward relative to the outer circumferential surface of the endless fusing belt in the radial direction.

10. The fixing device as claimed in claim 9, wherein the endless fusing belt defines a thickness between the inner circumferential surface and the outer circumferential surface, and wherein a protruding length of the protruding portions from the contact surface is at least one-half the thickness of the endless fusing belt.

11. The fixing device as claimed in claim 1, wherein the nip member further comprises:

a base portion providing a nip region in cooperation with the backup member for nipping the endless fusing belt therebetween, the base portion having a most upstream end in the moving direction; and a curved portion extending from the most upstream end of the base portion along the inner peripheral surface of the endless fusing belt;

wherein the base portion provides the contact surface, and the curved portion provides the contact surface and the non-contact surface.

12. The fixing device as claimed in claim 1, wherein the nip member further comprises a base member providing the outer surface, the base member having a most upstream end in the moving direction, and the protruding portions extending in the moving direction from the most upstream end of the base member.

13. A fixing device comprising:

an endless fusing belt configured to circularly move in a moving direction, the endless fusing belt having widthwise ends in a widthwise direction and an inner peripheral surface;

a heater;

a nip member formed of a single plate; and a backup member configured to nip the endless fusing belt in cooperation with the nip member, the nip member comprising:

a contact surface in contact with the inner peripheral surface of the endless fusing belt through a lubricant, the contact surface having an upstream end in the moving direction;

protruding portions respectively provided at positions outside the widthwise ends of the endless fusing belt in the widthwise direction and protruding toward the backup member relative to the contact surface, the protruding portions extending in the moving direction from positions upstream of the upstream end of the contact surface in the moving direction, a base portion providing a nip region in cooperation with the backup member for nipping the endless fusing belt therebetween, the base portion having an upstream end in the moving direction;

a base portion providing a nip region in cooperation with the backup member for nipping the endless fusing belt therebetween, the base portion having an upstream end in the moving direction; and a curved portion extending from the upstream end of the base portion along the inner peripheral surface of the endless fusing belt, the base portion and the curved portion providing the contact surface and being configured to receive radiant heat directly from the heater.

14. The fixing device as claimed in claim 13, wherein the backup member has an outer circumferential surface, and wherein the contact surface is recessed from a side on which the backup member is disposed toward a side on which the heater is disposed to form an arcuate shape in cross-section that conforms to the outer circumferential surface.

15. The fixing device as claimed in claim 13, wherein the nip member further comprises a base portion providing a nip region in cooperation with the backup member for nipping the endless fusing belt therebetween, the nip region having a downstream end in the moving direction, and wherein the protruding portions extend to positions downstream of the downstream end of the nip region in the moving direction.

16. The fixing device as claimed in claim 13, wherein the backup member includes a roller body having a widthwise length in the widthwise direction, and wherein each of the protruding portions has an inner surface in the widthwise direction, the inner surfaces of the protruding portions defining a distance therebetween in the widthwise direction, the distance being greater than the widthwise length.

17. A fixing device comprising:

an endless fusing belt configured to circularly move in a moving direction, the endless fusing belt having widthwise ends in a widthwise direction and an inner peripheral surface;

a heater;

a nip member formed of a single plate; and a backup member configured to nip the endless fusing belt in cooperation with the nip member, the backup member including a roller body having a widthwise length in the widthwise direction, the nip member comprising:

a contact surface in contact with the inner peripheral surface of the endless fusing belt through a lubricant, the contact surface having an upstream end in the moving direction; and protruding portions respectively provided at positions outside the widthwise ends of the endless fusing belt in the widthwise direction and protruding toward the backup member relative to the contact surface, the protruding portions extending in the moving direction from positions upstream of the upstream end of the contact surface in the moving direction each of the protruding portions having an inner surface in the widthwise direction, the inner surfaces of the protruding portions defining a distance therebetween in the widthwise direction, and the distance being greater than the widthwise length.

18. The fixing device as claimed in claim 17, wherein the backup member has an outer circumferential surface, and wherein the contact surface is recessed from a side on which the backup member is disposed toward a side on which the heater is disposed to form an arcuate shape in cross-section that conforms to the outer circumferential surface.

19. The fixing device as claimed in claim 17, wherein the nip member further comprises a base portion providing a nip region in cooperation with the backup member for nipping the endless fusing belt therebetween, the nip region having a downstream end in the moving direction, and wherein the protruding portions extend to positions downstream of the downstream end of the nip region in the moving direction.

* * * * *